US005823631A

United States Patent [19]

Herbolzheimer et al.

[11] Patent Number: 5,823,631

[45] Date of Patent: Oct. 20, 1998

[54] SLURRIFIED RESERVOIR HYDROCARBON RECOVERY PROCESS

[75] Inventors: Eric Herbolzheimer, Watchung; Paul M. Chaikin, Pennington, both of N.J.

[73] Assignee: Exxon Research and Engineering Company, Florham Park, N.J.

[21] Appl. No.: 630,954

[22] Filed: Apr. 5, 1996

[51] Int. Cl.[6] ..... E21B 43/40; E21C 41/24

[52] U.S. Cl. ..... 299/4; 299/7; 166/275

[58] Field of Search ..... 166/268, 245, 166/275, 52; 299/3, 4, 7, 9

[56] References Cited

U.S. PATENT DOCUMENTS 3,407,003 10/1968 Durie ..... 299/4
4,212,353 7/1980 Hall ..... 299/7 X
4,234,232 11/1980 Smith et al. ..... 299/7 X
4,362,212 12/1982 Schulz ..... 166/263 X
4,398,769 8/1983 Jacoby ..... 299/4
4,437,706 3/1984 Johnson ..... 299/7

*Primary Examiner*—Roger J. Schoeppel
*Attorney, Agent, or Firm*—Jay Simon

[57] ABSTRACT

Hydrocarbons trapped in solid media, such as bitumen in tar sands may be recovered from deep formations by relieving the stress of the overburden and causing the formation to flow from an injection well to a production well, for example, by fluid injection, recovering a tar sand/water mixture from the production well, separating the bitumen and reinjecting the remaining sand in a water slurry.

12 Claims, 5 Drawing Sheets

SLURRIFIED RESERVOIR HYDROCARBON RECOVERY PROCESS

FIELD OF THE INVENTION

This invention relates to the recovery of hydrocarbon containing media from formations covered by an overburden, and ultimately to the recovery of the hydrocarbon materials, e.g., bitumen, from oil sands. More particularly, this invention relates to a recovery system for hydrocarbon containing media using accessing and production wells rather than to a system involving mechanical mining, e.g., draglines or displacement of the hydrocarbon through a stationary porous formation.

BACKGROUND OF THE INVENTION

Currently, bitumen, for example, contained in tar sands is produced either by cyclic steam stimulation for reserves more than three hundred meters underground or by surface mining for reserves less than about fifty meters underground. While other steam based processes for recovering bitumen from deep formations have been tested, none of these processes have demonstrated the potential to decrease production costs significantly. Other processes based on cold flow, where the formation is not heated, involve fitting a well with a pump capable of handling sand/oil/water slurries. The flowing fluids continuously dislodge sand adjacent to the well bore causing a cavern or network of worm holes to form, and thereby effectively enhance the well bore and production rates. Nevertheless, the process has its shortcomings and bitumen production falls off with time as the drive energy in the formation decreases. Consequently, there remains a need for producing materials from these formations in a continuous, price effective manner, and thereby tap some of the world's largest reserves of hydrocarbons.

SUMMARY OF THE INVENTION

In accordance with this invention a method is provided for converting the hydrocarbon bearing media into a formation resembling a moving bed. Thus, deep formations that are under considerable pressure by virtue of the stress provided by the overburden are turned into formations that move or flow and can be harvested through production wells. However, important to the invention is removing the stress provided by the overburden thereby allowing the media to move or flow. Overburden stress removal is accomplished by raising the pore pressure in the formation until that pressure is essentially equal to the total stress provided by the overburden.

Having raised the pressure in the formation sufficiently to allow the media to flow or move, a pressure differential is applied between an injection well and a producing well causing the formation to flow to the producing well. Sand-containing hydrocarbons, for example, are then recovered from the producing well, and the hydrocarbon, e.g., bitumen, is extracted from the sand by known methods involving cold water, hot water or naphtha treatment. The hydrocarbon depleted sand, preferably a sand essentially free of hydrocarbons, is then reinjected, preferably slurried in water, through injection wells, into the formation, thereby maintaining a stable formation and causing displacement of the hydrocarbon bearing media to the production well or wells. As a consequence of this slurry injection, the difficult problem of sand disposal is effectively eliminated, the sand ending up in the same place as it started, albeit depleted of its hydrocarbons.

DETAILED DESCRIPTION OF THE INVENTION

Figure 1:
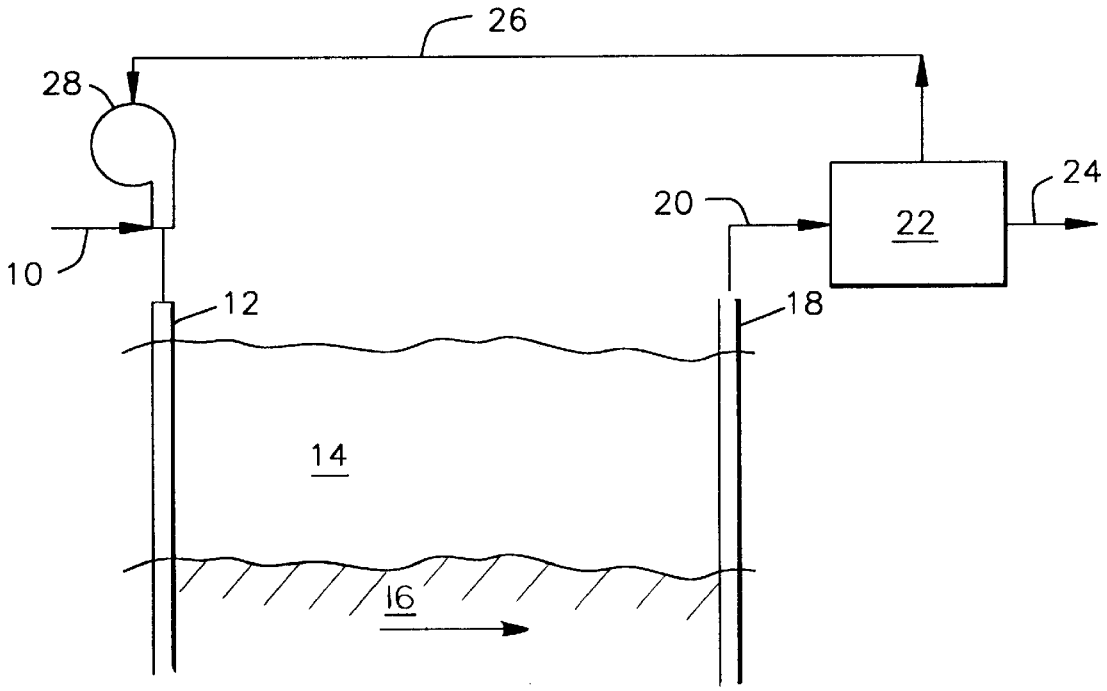
FIG. 1 is a schematic showing the operation of the invention.

The easiest, most cost effective way to overcome the overburden pressure is by water injection through injection wells accessing the formation, preferably at the lower portions of the formations. Uncemented or substantially uncemented formations are particularly applicable for this invention since cemented formations when subjected to the process of this invention can lead to formation fracturing and the occurrence of channels that bypass much of the hydrocarbon containing media and do not lead to efficient flow or movement of the formation and, therefore, do not lead to efficient hydrocarbon production. Thus, uncemented or substantially uncemented formations are those that allow the water to permeate substantially all of the pores in the formation.

While formation fracturing is to be substantially avoided, some minimal vertical fracturing may occur at the onset of water injection. Horizontal fracturing is less objectionable, and, in some cases, beneficial, as it allows the water and elevated pressure to quickly permeate the formation, after which any horizontal fractures will be substantially filled in by water laden sands.

Usually, although not necessarily, pressure equilibration in the formation will occur in a finite time period, e.g., 10 to 300 days, preferably 10 to 50 days. Pressure in the formation can easily be measured by pressure sensors located either at the surface of the overburden or down hole or both.

At least two wells accessing the formation are necessary. However, when the stress of the overburden is being removed water injection may be effected through both or all of the wells. When production starts, at least one well for continued injection of water or a slurried media is required and at least one production well is required. Those skilled in the art are aware of the "five-spot" production method where wells are drilled into the formation at the coners of a box and a fifth well is drilled at the center of the box; thus resembling the position of the emblems on a five of a deck of cards. The central well is then used as the injecting well and an elliptical production pattern emanating from the central injection well to each of the corner production wells is achieved. In this configuration, as well as other configurations, all of the wells may be used as injection wells when injecting fluid to relieve the stress of the overburden.

Upon achieving the appropriate pore pressure in the formation a pressure differential is applied to the formation, causing the formation to flow or move from the injection well or wells into which, e.g., fluids or sands, are continually pumped, to the production wells from which hydrocarbon bearing media, e.g., tar sands, are recovered. The pressure differential may be applied before the desired formation pore pressure is achieved, although a greater pressure may be required to move or flow the media.

The pressure differential may be created in a variety of ways, for example, by appropriate valving on the production wells that allows flow through these wells as fluid is pumped into the injection well. In the preferred embodiment, the pressure gradient is applied by raising the pore pressure at the injection well to a value above the stress applied by the overburden, while lowering the pore pressure at the production well to a value below the stress applied by the overburden. The pressure difference is set so as to apply a sufficient force on the sand to overcome the friction force that tends to hold the hydrocarbon bearing media in place. At the same time, these pressures should be controlled in a manner so that the average pore pressure in the portion of the formation under production is maintained roughly or substantially equal to the stress applied by the overburden, thereby minimizing the friction force impeding the movement of the hydrocarbon bearing media in place, and minimizing the pressure gradient needed for production.

As the hydrocarbon containing media is collected at the producing well, it is transported to a hydrocarbon recovery stage. Hydrocarbon or bitumen recovery from, for example, tar sands, is accomplished by well known methods such as naphtha or hot water stripping.

Upon separating the hydrocarbon from the solid media and water, an essentially hydrocarbon-free, water/sand slurry is obtained. One of the major advantages of this invention, as opposed to surface mining, is that the media is easily disposed of by pumping it back into the formation as a slurry, preferably a water slurry. This water/sand slurry will have a solids content greater than 30% by volume, and more typically greater than 50% by volume. It may also include other additives. The sand/water slurry pumped back into the formation serves not only to dispose of the sand but more importantly as a means for maintaining the integrity of the formation, i.e., preventing slumping of the formation. The returning slurry also acts to displace the hydrocarbon containing media, pushing it towards the production wells. Using slurry rather than fluids as the displacing media maintains stable displacement and suppresses bypassing of the injected material over the top of the in situ hydrocarbon bearing media.

Turning now to the drawings, in FIG. 1, water in line 10 is injected via injection well 12, and possibly also via production well 18, through the overburden 14 and into the hydrocarbon bearing formation, e.g., tar sands, 16. During this formation preconditioning step, the fluid injection may be continuous or it may be stopped after some time and the wells "shut-in" while the pore pressure equilibrates in the portion of the formation being prepared for production. Once the effective stress on the sands is minimized, e.g., by equilibration of the elevated pore pressure in the formation, a pore pressure gradient is established between wells 12 and 18 by stopping the injection of fluid into, and regulating production out of, well 18 while injecting fluid, or slurry, into well 12. Hence, the formation will flow (in the direction of the arrow) to production well 18 through which a mixture of tar sands and water are recovered in line 20 and sent to bitumen recovery unit 22 from which bitumen is separated for further upgrading in line 24. At some time either at or after the commencement of production, the injected media is changed from pure fluid to a slurry. This is accomplished by returning the essentially hydrocarbon free sand, with at least a portion, that is, all or part, of any accompanying water (or possibly with additional water) from the separation plant 22 to the injection pump 28 via the slurry pipeline 26. Prior to being fed to pump 28 or prior to injection into the formation through well 12, the sand/water slurry may be mixed with more water from line 10, mixed with some other material, or concentrated by removal of some of the water, which may be used to aid the pipelining of the produced slurry to the production plant 22.

The system operates in the manner described when the force of the fluid or slurry pumped into the injection well overcomes the friction effect. In its simplest form this occurs in the following way: When a pore pressure gradient is applied to the hydrocarbon bearing formation, the fluids in the pore space, e.g., oil or bitumen and water, tend to flow relative to the sand grains and in the direction down the pressure gradient. This relative motion between the fluid and the sand creates a viscous drag, described by Darcy's law, on the sand tending to push the sand towards the production well. This viscous force is resisted, however, by the friction holding the sand in place. At the top of the hydrocarbon bearing media, this friction force is proportional to the effective stress applied to the sand by the overburden. Hence, when the average pore pressure equals the stress applied by the overburden, the overburden is fully supported by the pore pressure and the friction force applied at the top of the hydrocarbon bearing media is eliminated or minimized. On the other hand, at the bottom of the hydrocarbon bearing formation, the friction force is proportional to stress applied by the overburden to the top of the formation plus the buoyant weight of the sands of the hydrocarbon bearing media. Hence, raising the pore pressure to support the overburden also minimizes the friction force at the bottom of the hydrocarbon bearing media, and, therefore, minimizes the pressure gradient required to move the media.

The hydrocarbon bearing media will move toward the production well provided the applied pore pressure gradient is large enough to overcome the friction holding the sands in place. With the simple model described above, the required pressure gradient is given by $$-\frac{dp}{dx} = \left(2\frac{\sigma_{ob}}{h} + \Delta\rho g c\right)\tan(\psi) \tag{1}$$

where, p is the local value of the pore pressure, x is the coordinate between the injection and production wells, $\sigma_{ob}$ is the effective stress applied to the sands by the overburden, h is the thickness of the hydrocarbon bearing media, g is the gravitational constant, c is the volume fraction of the hydrocarbon bearing media occupied by sand, $\Delta\rho$ is the density difference between the sand and the fluids in the pore space, and $\tan(\Psi)$ is the friction coefficient between the sands and the underlying formation. Furthermore, according to Darcy's law, this pressure gradient will be attained when the superficial velocity of the injected fluids is given by $$v_c = \frac{k}{\mu}\left(2\frac{\sigma_{ob}}{h} + \Delta\rho g c\right)\tan(\psi) \tag{2}$$

where $\mu$ is the viscosity of the fluids flowing in the pore space, e.g., water, and k is the permeability of the hydrocarbon bearing media to these flowing fluids. If the injection rate exceeds this value, the sands simply move with the injection velocity minus the velocity given by this formula.

Thus, it is apparent that minimizing the stress applied to the hydrocarbon bearing formation by the overburden, by supporting the overburden by the average pore pressure, minimizes both the pressure gradient needed to move the media and the injection rate needed to create the required pressure gradient. Furthermore, since the pressure gradient does not depend on the fluid viscosity or on the permeability of the media, as it does in conventional techniques of oil recovery, high viscosity of the pore fluids or low permeability do not act to increase the resistance to flow, but instead minimize the amount the fluids move relative to the hydrocarbon bearing formation, thereby minimizing the amount of fluids that must be pumped in the media in order to recover the hydrocarbon. Thus, high viscosity of the hydrocarbons actually benefit this process, thereby highlighting its utility for recovery of bitumen and other very viscous hydrocarbons.

It is also apparent from Equation (2) that if the permeability to the moving fluids is increased, the sands will move more slowly. This can have consequences for the optimal nature of the injected material. The permeability to water will typically be lower in the in situ hydrocarbon bearing media than it would be in the same sands with the hydrocarbon removed. Hence, if the same sands are slurried with water and used as the displacing fluid, the in situ sands will tend to move faster in the formation than will the injected sands. This could tend to open voids in the formation, with undesirable consequences. Hence, it can be beneficial to add materials to reinjected sands in order to reduce their permeability to water, such as fine particles or clays, or other materials that will reduce the permeability to water of the injected materials. Optimally, this would be done in a manner so as to render the critical velocity, described by Equation (2), the same in the injected sands as it is in the in situ hydrocarbon bearing media.

Example 1

Sand was packed into a Plexiglas rectangular cell which was 25 cm long by 6 cm tall and 0.6 cm wide. There was an exit hole in one end of the cell and an entrance hole in the other end. Sand was packed into the cell and then the pore space was filled with mineral oil. During this filling of the pore space, a fine mesh screen was fitted over the exit hole to prevent the sand from moving. After the sand was fully saturated, the screen was removed so that the sand could exit the cell together with the produced oil.

The oil injection was then continued at a rate of 9 ml/hr, which produced an average velocity in the cell which was 18 times the critical velocity described by Equation (2) above. Initially, sand was produced with the oil, but after a short time the sand production stopped and only oil flowed out of the sand. Visual observations of the cell showed that, after a small amount of sand was produced, the sand remaining in the cell slumped down, and the oil injected in the injection hole bypassed over the remaining sands. Thus, only a small portion of the original in situ oil and sand were produced, resulting in very poor performance as an oil recovery process.

Example 2

The experiment described in Example 1 was repeated with the exception that, after the cell was packed with sand and the sand was saturated with oil, the inlet line was also packed with sand. Thus, as the incoming oil flowed along the inlet line it could drag this sand along, thereby feeding slurry into the cell rather than just pure oil. Using slurry rather than fluid as the displacing media in this manner resulted in a stable displacement of the in situ oil and sand. The injected sands tended to keep the cell packed with sand from top to bottom, thereby suppressing bypassing of the injected material over the top of the in situ sands. This resulted in nearly uniform displacement of the sands, and, consequently, a very efficient oil recovery process. This effectively demonstrates the importance of using slurry as the displacement media for this process.

This process has been repeated in cells with several cross-sectional shapes and sizes, using a broad range of injection flow rates. Stable, uniform displacements, with low pressure gradients, have been achieved in all cases provided the injection velocity is large enough to overcome the frictional forces holding the sands in place.

Example 3

The same type of experiment described in Examples 1 and 2 was repeated in a cell designed to replicate a classic "five-spot" pattern, which is commonly used in field practice for oil recovery. The cell consisted of two circular Plexiglas plates with diameter of 38 cm and thickness of 1.25 cm, separated at a distance of 0.6 cm by neoprene spacers with a 33 cm diameter hole cut out of their centers. The Plexiglas plates and spacers were held together by bolts around the perimeter of the plates. The cell was oriented so that the circular plates were horizontal. The top plate had four 1 cm holes, evenly spaced around the circumference, at a distance of 15 cm from the center of the plate. These four holes served as the injection wells. There was an additional 1 cm hole in the center of the plate that served as the production well. There were also six small holes drilled in a line from one of the injection holes to the production hole. These were fitted with pressure transducers that were used to measure the pressure gradients during the displacement process.

Initially, the center hole and three of the injection holes were plugged and the cell was packed with sand by feeding dry sand to the remaining hole. The sand was added in successive layers, about 2 cm deep; after each layer was added the cell was shaken and tapped to help compact the sand. This was continued until the cell was completely packed with sand. The resulting porosity of the sand pack was measured to be 0.38, while the permeability was about 50 Darcies.

The cell was then mounted horizontally, and the plugs in the holes were removed. A screen was placed in the center hole, in order to hold the sands in place, and mineral oil, with viscosity of 2 Poise, was then injected simultaneously into the four injection holes around the perimeter of the cell. Once the pore space was completely saturated with oil, the screen was removed from the center hole and a production tube was then fitted to it, and injection tubes were attached to the four injection holes. Each of the injection tubes was fitted with a reservoir that contained the same type of sand that was packed into the cell. The pore space in these reservoirs was filled with the same mineral oil that was used to saturate the cell. Mineral oil was then fed to the top of each reservoir at a controlled flow rate via positive displacement pumps. Hence, the total flow rate was controlled at each injection well, but the incoming material could be either pure mineral oil or a slurry of sand and mineral oil, depending on whether or not the conditions in the cell allowed sand flow. The sand originally packed in the cell consisted of black and white sands packed in bands in order to visualize the velocity pattern as the sands moved; the injected sand was red, so it was easy to visualize the progression of the displacement.

Figure 2:
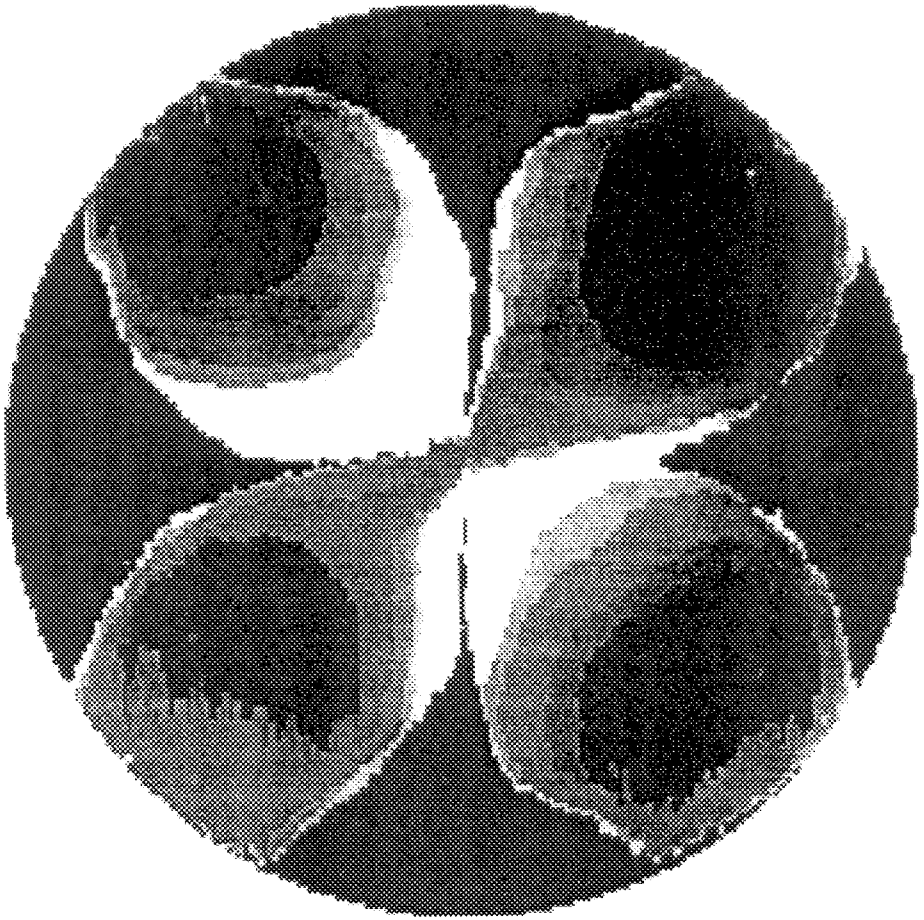
FIG. 2 is a picture of the evolution of the displacement in a "five-spot" pattern laboratory experiment.

If the injection flow rate was sufficiently small, the in situ sands remained stationary and the pressure gradient increased linearly with flow rate, in a manner consistent with Darcy's law. When the critical flow rate was exceeded, however, the in situ sands started to be displaced and sand started to flow in from the reservoirs to take their place. FIG. 2 shows the evolution of the displacement, the different shades of gray representing the extent of penetration of the injected sands at progressively later stages of the process. The displacement was observed to be uniform in the vertical direction, i.e., the displacement patterns were the same on the top and bottom of the cell. Hence, the total recovery was typically at least 50–70% at the time the injected sands reached the production well.

Figure 3:
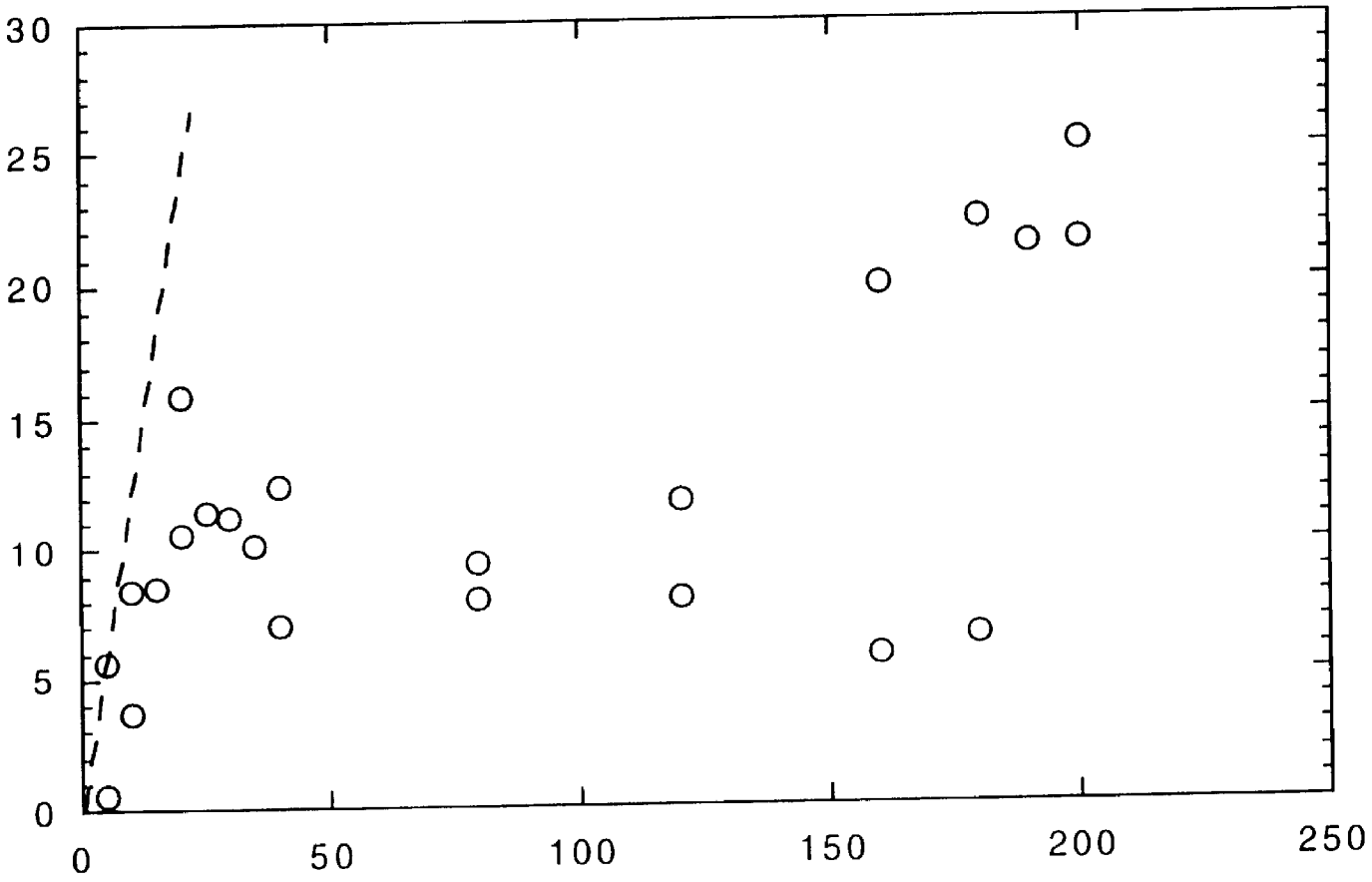
FIG. 3 is a plot of the observed pressure gradient (ordinate) kPa/m required to sustain flow versus the flow rate (abscissa) ml/hr/injector into each of the injection wells. The dashed line is the extension of the results with no particle motion.

As the injection flow rate was increased above the critical value, the sand displacement rate also increased linearly. On the other hand, the pressure gradient became nearly independent of flow rate, remaining essentially at the value required to initiate sand flow in the cell. This is shown in FIG. 3 which shows the observed pressure gradient as a function of the flow rate into each of the four injection wells, measured in ml/hr. Also shown in FIG. 3 is the pressure gradient that would be required to maintain the same production rate if the sands remained stationary. Clearly, the pressure gradient required once sand flow is initiated is much lower, demonstrating the utility of the invention.

Example 4

The experiment described in Example 3 was repeated with the exception that glass beads were glued to the bottom plate in order to alter the ability of the sand to slide along this surface. Otherwise, the experimental procedure was the same as described above.

Figure 4:
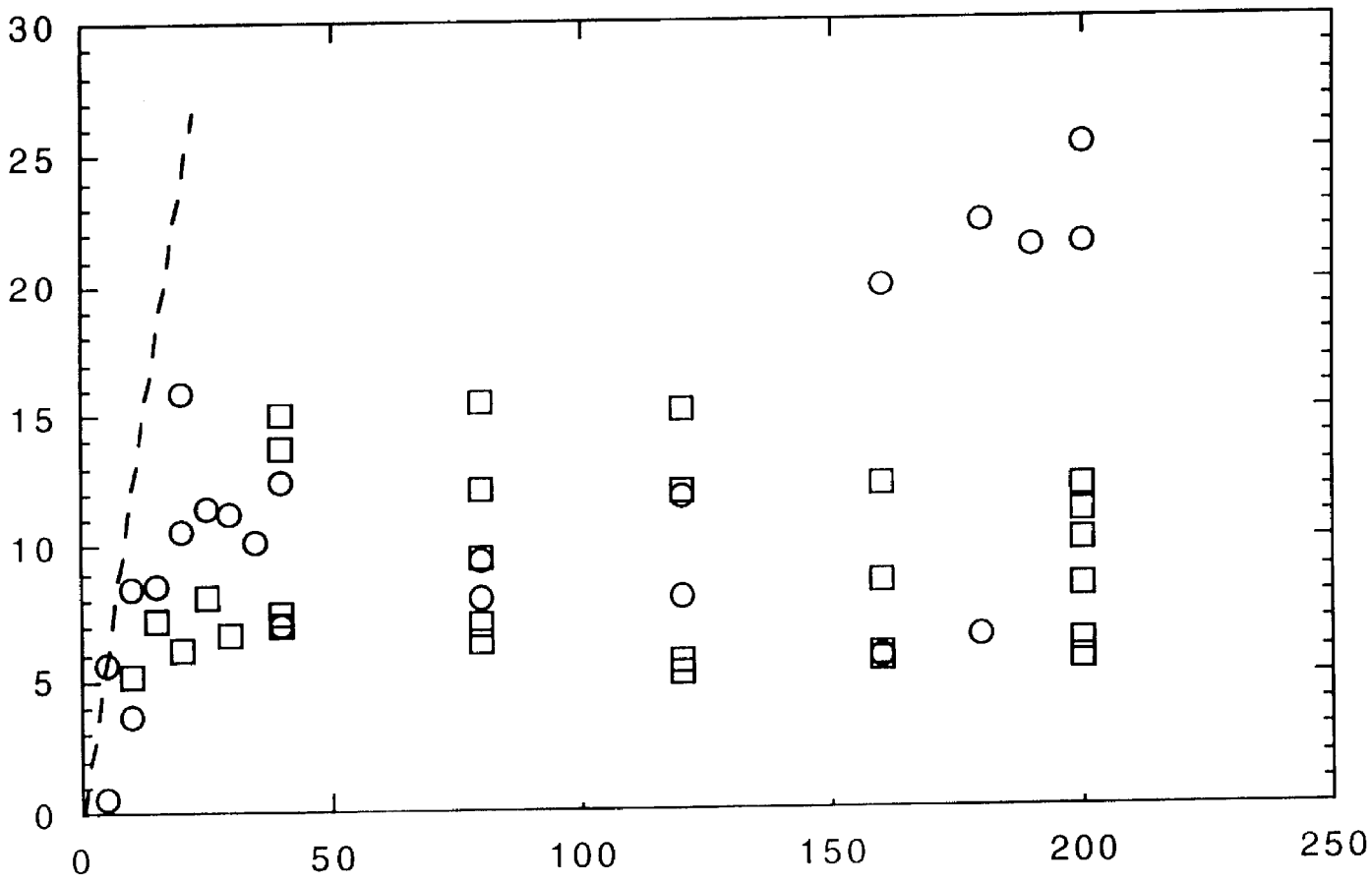
FIG. 4 is a comparison of the observed pressure gradient (ordinate) kPa/m versus injection flow rate (abscissa) ml/hr/injector in a cell with a smooth bottom (open circles) to that in a cell with a roughened bottom (open squares).

The displacement patterns were very similar to those observed in Example 3, achieving the same high level of overall recovery at breakthrough. Furthermore, as shown in FIG. 4, the measured pressure gradients required to sustain the flow were very similar to those observed with the smooth bottom surface. This confirms the robustness of the process to changes in the details in material parameters.

Example 5

The experiment described in Example 3 was repeated with the exception that an extra, movable circular plate was installed in the cell. This plate was constructed by gluing a 2 mm thick circular plate with a diameter of 30 cm to a thin, flexible vinyl sheet. The vinyl sheet was clamped between the same type of neoprene spacers described in Example 3 in order to hold the sheet in place and to seal the cell. The spacers also allowed the inserted plate to move up and down, thereby simulating the possible movement of the overburden in the field.

Next, wires were inserted between the movable plate and the bottom plate and a vacuum was applied to the space between these two plates. This effectively held the moveable plate in place while the space between the movable plate and the top plate was packed with sand and saturated with oil as described in Example 3. The cell was then turned upside down and the wires, which had served as spacers, removed. Pressure was then applied to the space between the moveable plate and the bottom plate and the cell was turned right side up. Various levels of pressure could then be applied to the space under the movable plate, thereby simulating the application of an overburden pressure in the field.

A further modification to the experiment was that the outlet tube from the cell was attached to a large reservoir whose pressure could be regulated. By increasing the pressure in this collection vessel, the back pressure to the production tube could be increased, thereby increasing the average pore pressure in the cell. This directly simulated increasing the pore pressure in order to partially or totally counterbalance the stress applied by the overburden pressure. Thus, this experiment was a direct test of the invention and whether increasing the pore pressure would decrease the resistance to the sand flow, and, therefore, the pressure gradient required to maintain the production.

After the cell was packed with sand, saturated with mineral oil, and readied for production and injection as described above, 3 psig of pressure was applied to the space under the movable plate. Initially, no back pressure was applied to the collection vessel and injection was started through the four injection wells. Under these conditions, no motion of the sand occurred. The back pressure was increased in small increments and no significant sand flow was observed until the average pore pressure in the cell became equal to about 3 psig, i.e., when the average pore pressure essentially equaled the overburden pressure. This is a confirmation of the principles and utility of the invention.

Figure 5:
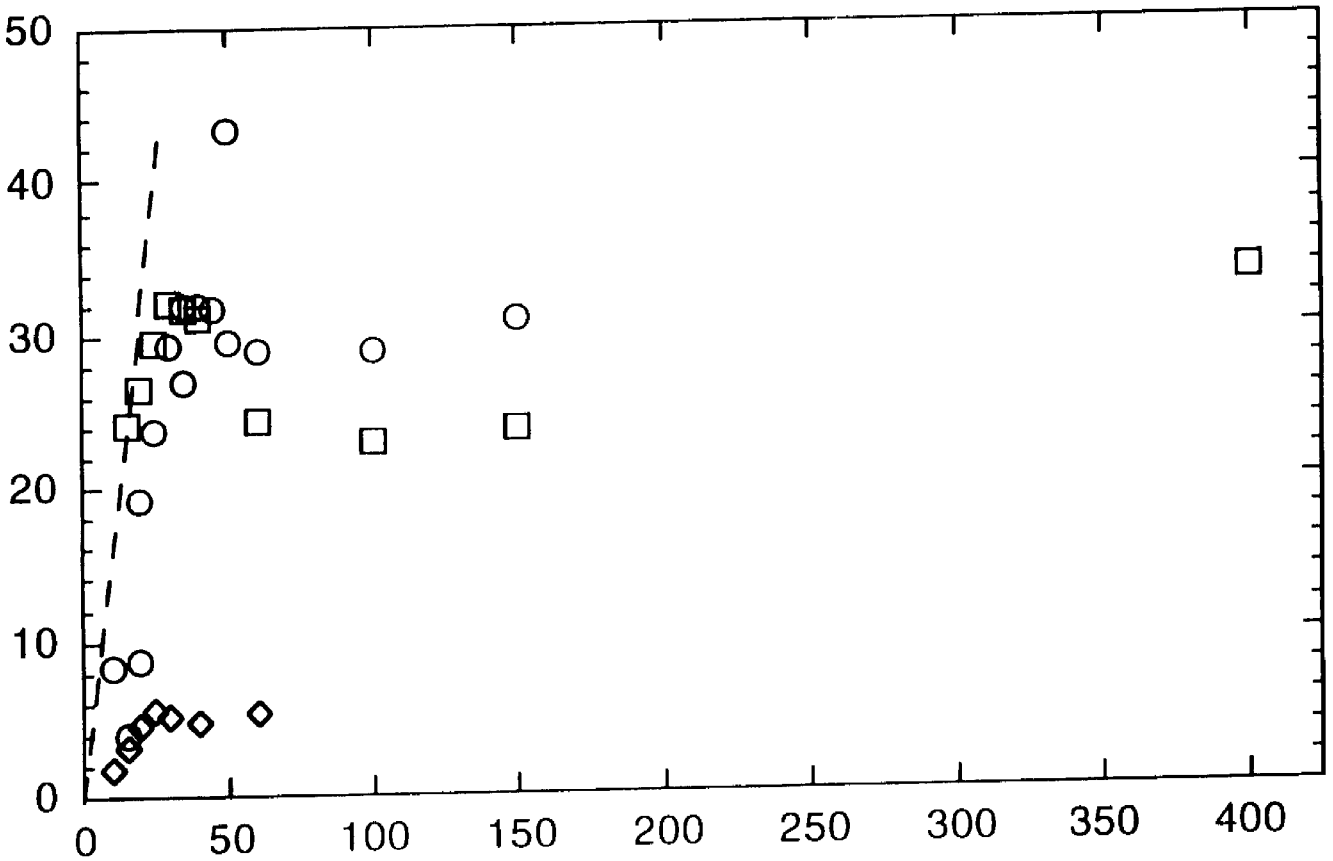
FIG. 5 is the observed pressure gradient (ordinate) kPa/m versus injection flow rate (abscissa) ml/hr/injector for applied outlet back pressures of 0 psig (open circles), 1 psig (open squares), and 2 psig (diamonds) when the applied overburden pressure is 3 psig.

FIG. 5 shows the measured pressure gradients versus the flow rate into each of the four injection wells for three different values of the back pressure. In all three cases, the pressure gradient increases linearly with flow rate until sand flow starts; as the flow rate is increased further the pressure gradient remains constant, as in the Examples above. Furthermore, as the back pressure is increased, and, therefore, as the effective stress applied by the overburden is decreased, sand flow commences at a lower value of the flow rate and at a lower pressure gradient. When the back pressure equaled 2 psig, the average pore pressure in the cell equaled 3 psig, and the observed pressure gradient required to sustain flow was small and in close agreement with that predicted by Equation (1). The observed overall recovery at breakthrough was also very high, i.e., about 70%.

Those skilled in the art of recovering hydrocarbon bearing solid media will be well aware of variables that may change the specifics of the process but not the overall process scheme. For example, particle stresses and stress gradients or cohesion in the sand may modify the pressure gradient and the injection rate needed to move the media. Also, the solid media may contain clays or clay like material which may cause the formation to be cemented to some degree. While water at ambient temperature, is the preferred injection fluid, the water may be heated, for example, to 50°–100° C. or additives may be used to overcome clay like formations, substantially eliminate fracturing of the formation, and cause the solid media to flow.

Depth of seam or formation may also require modest changes to the process, although maintaining pore pressures in the formation of 10–100 bar, preferably 50–100 bar will be adequate to relieve the stress of the overburden.

The process will also be more effective where the formation is located between natural barriers, e.g., shale layers, that will not allow the injected water, whether initially, or as part of the solid media slurry to leak off and lower the pore pressure.

What is claimed is:

1. A process for recovering hydrocarbon containing media from a hydrocarbon containing media formation having a pore pressure located beneath an overburden comprising:

(a) accessing the formation;

(b) raising the pore pressure in the formation such that when a pressure differential is applied between injection and production wells accessing the formation, at least a portion of the hydrocarbon containing media will flow;

(c) injecting a slurry of a hydrocarbon depleted material into the formation; and (d) displacing at least a portion of the hydrocarbon containing media through at least one production well.

2. The process of claim 1 characterized in that the pore-pressure is essentially that of the overburden.

3. The process of claim 1 characterized in that the formation is essentially uncemented.

4. The process of claim 1 characterized in that there is a substantial absence of vertical fracturing in the formation.

5. The process of claim 1 characterized in that the hydrocarbon containing media are tar sands.

6. The process of claim 1 characterized in that the slurry of step (c) is a water-sand slurry.

7. The process of claim 6 characterized in that the slurry also contains water permeability reducing materials.

8. The process of claim 7 characterized in that the permeability reducing material contains clay.

9. The process of claim 1 characterized in that the hydrocarbon containing media is recovered from the production well and hydrocarbons are recovered from the media by naphtha, extraction cold water extraction or hot water extraction.

10. The process of claim 5 characterized in that the pressure differential in step (b) is represented as $$-\frac{dp}{dx} = \left(2\frac{\sigma_{ob}}{h} + \Delta\rho g c\right)\tan(\psi)$$

wherein p is the local value of the pore pressure, x is the coordinate between the injection and production wells $\sigma_{ob}$ is the effective stress applied to the hydrocarbon containing media by the overburden h is the thickness of the hydrocarbon bearing media g is the gravitational constant c is the volume fraction of the hydrocarbon containing media occupied by the sand $\Delta\rho$ is the density difference between the sand and fluids in the pore space, and $\tan(\Psi)$ is the friction coefficient between the sand and the formation.

11. The process of claim 1 characterized in that the pore-pressure in the formation is raised by injecting fluid into the formation.

12. The process of claim 11 characterized in that the fluid is water or water containing.

* * * * *